US010403242B2

(12) United States Patent
Konduru

(10) Patent No.: US 10,403,242 B2
(45) Date of Patent: Sep. 3, 2019

(54) SEMI-SELF-REFRESH FOR NON-SELF-RESEARCH DISPLAYS

(71) Applicant: INTEL CORPORATION, Santa Clara, CA (US)

(72) Inventor: Chandra Mohan Konduru, Folsom, CA (US)

(73) Assignee: INTEL CORPORATION, Santa Clara, CA (US)

( * ) Notice: Subject to any disclaimer, the term of this patent is extended or adjusted under 35 U.S.C. 154(b) by 7 days.

(21) Appl. No.: 15/201,362

(22) Filed: Jul. 1, 2016

(65) Prior Publication Data

US 2018/0005609 A1 Jan. 4, 2018

(51) Int. Cl.
*G09G 3/36* (2006.01)
*G09G 5/393* (2006.01)

(52) U.S. Cl.
CPC ..... *G09G 5/393* (2013.01); *G09G 2330/021* (2013.01); *G09G 2360/121* (2013.01); *G09G 2360/18* (2013.01)

(58) Field of Classification Search
CPC ..... G09G 3/3618; G09G 5/393; G09G 2360/121; G09G 2330/021; G09G 2360/18; G06F 13/1636
See application file for complete search history.

(56) References Cited

U.S. PATENT DOCUMENTS 9,508,111 B1 * 11/2016 Ogrinc ..... G09G 5/14
2006/0146056 A1 * 7/2006 Wyatt ..... G09G 5/006 345/501
2008/0001934 A1 * 1/2008 Wyatt ..... G09G 3/3618 345/204
2008/0174606 A1 * 7/2008 Rengarajan ..... G09G 3/20 345/531
2012/0188262 A1 * 7/2012 Rabii ..... G09G 5/393 345/534
2012/0236013 A1 * 9/2012 Wyatt ..... G06F 1/325 345/522

* cited by examiner

*Primary Examiner* — Diane M Wills

(57) ABSTRACT

Disclosed herein is a display controller and display controller techniques to self-refresh a non-self-refresh display. The display controller can be configured to determine when display data is static. During periods where display data is static, the display controller can cache display data output in device memory and "refresh" the display data using the cached display data output. A display controller can receive a number of display data elements to be overlaid. The display controller can blend the display data elements into blended display data and can send the blended display data to a display. The display controller can determine whether the display data elements are static. The display controller can cache the blended display data based on determining that the display data elements are static and can send the cached blended display data to the display every refresh while the display data elements are no longer static.

19 Claims, 9 Drawing Sheets

SEMI-SELF-REFRESH FOR NON-SELF-RESEARCH DISPLAYS

TECHNICAL FIELD

Embodiments herein generally relate to display controllers and more particularly to processing data by display controllers.

BACKGROUND

Modern displays repeatedly "refresh" or "redisplay" content. Typically, a display will have a refresh rate of about 60 Hz. Accordingly, display data is presented to the display at least 60 times per second, or at least once every 16.6 milliseconds. It is noted, that conventional displays refresh the displayed content regardless of whether the content has changed. That is, irrespective of whether the display data changed, at least once every 16.6 milliseconds, display data is moved from memory through the display pipeline to the display. During periods where fast moving content is displayed (e.g., video playback, game play, scrolling, or the like) the update frequency is necessary to provide a consistent viewing experience to the viewer. However, during periods where static content is displayed (e.g., reading a webpage, viewing static images, or the like) the update frequency includes repeatedly processing the same data in the display pipeline, which can lead to unnecessary power consumption by components in the display data pipeline as well as memory components.

A few modern displays include features to "self-refresh" the display. More specifically, the display includes memory to cache or store the contents of the display data buffers. As such, during periods where the display data is static, the display can refresh from its internal memory as opposed to requiring the display pipeline to provide the display data, which is fetched from the system's display data source at each refresh interval. Accordingly, the display pipeline can be placed in a lower power state. However, many modern displays do not have a self-refresh capability. Furthermore, in some instances manufactures do not implement self-refresh capabilities because it can significantly add to the cost of the device, for example, by requiring additional memory to be added to the display, or it cannot be added due to size or thermal limitations in the design.

DETAILED DESCRIPTION

Figure 1:
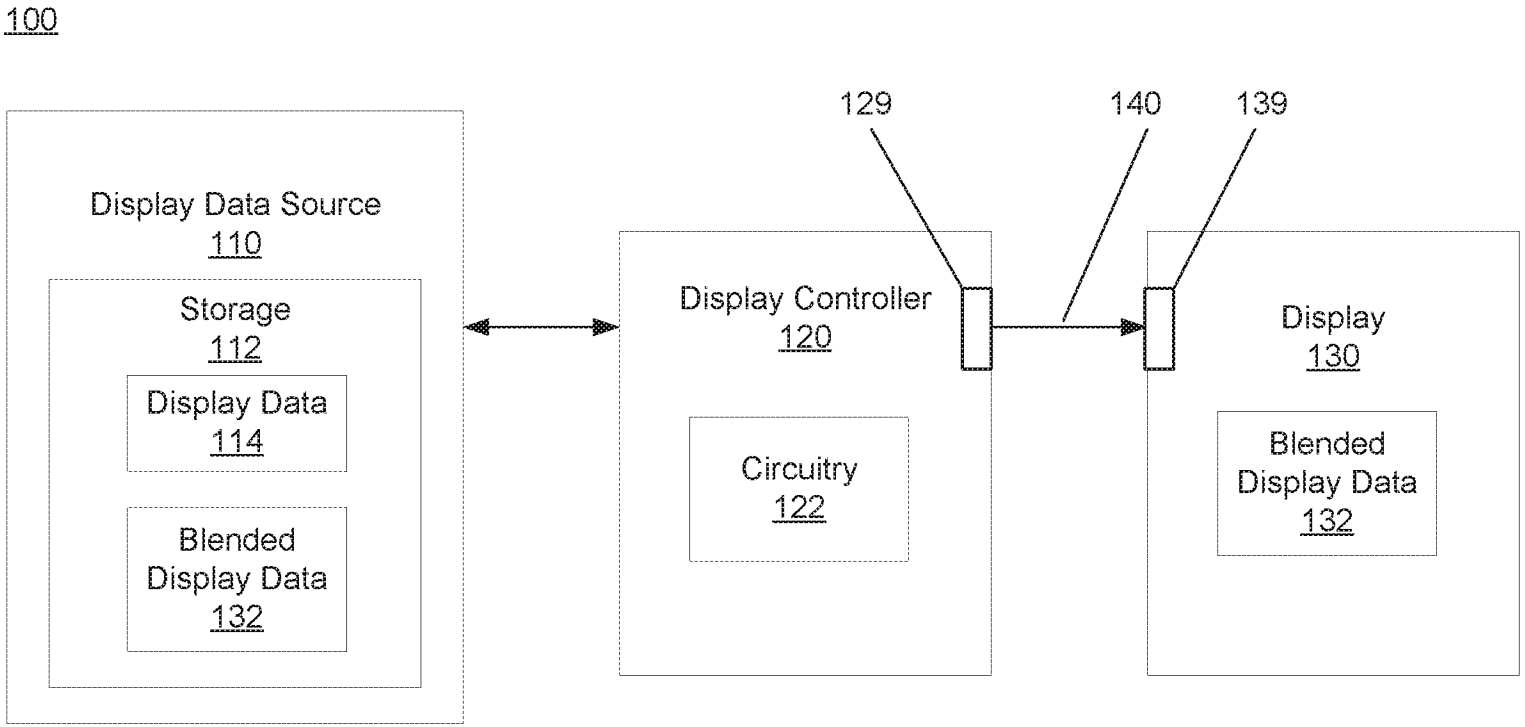
FIG. 1 illustrates a system to self-refresh onto a non-self-refresh display.

Various embodiments may be generally directed to display controllers, display pipelines, and computing devices to semi-self-refresh onto non-self-refresh displays. The present disclose provides a display controller and display data processing techniques to self-refresh onto a non-self-refresh display. In particular, the display controller can be configured to determine when display data is static. During periods where display data is static, the display controller can cache display data output in device memory and "refresh" the display data using the cached display data output. More specifically, the display controller can generally be configured to receive a number of display data elements to be overlaid. The display controller can blend the display data elements into blended display data and can send the blended display data to a display. The display controller can be configured to repeatedly receive display data elements, blend the display data elements, and send the blended display data to the display, for example, every t milliseconds, where t is the refresh interval of the display. Additionally, the display controller can determine whether the display data elements are static. The display controller can cache the blended display data (e.g., in device memory, in a register of the display controller, or the like) based on determining that the display data elements are static and can send the cached blended display data to the display every t milliseconds until a determination is made that the display data elements are no longer static.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, known structures and devices are shown in block diagram form in order to facilitate a description thereof. The intention is to provide a thorough description such that all modifications, equivalents, and alternatives within the scope of the claims are sufficiently described.

Additionally, reference may be made to variables, such as, "a", "b", "c", which are used to denote components where more than one component may be implemented. It is important to note, that there need not necessarily be multiple components and further, where multiple components are implemented, they need not be identical. Instead, use of variables to reference components in the figures is done for convenience and clarity of presentation.

FIG. 1 illustrates a block diagram of a system 100 to semi-self-refresh a display. In various examples, the system 100 may include a display data source 110, a display controller 120, and a display 130. The display data source 110 includes storage 112 to store display data 114. In general, the display data source 110 provides multiple layers of display data to be combined into a composite display frame for display on the display 130. More specifically, the display data source 110 provides display data 114 including multiple display data elements (e.g., refer to FIGS. 3 and 4A-4B). For example, storage 112 can include multiple memory locations, registers, or the like that each include an indication of display data elements to be combined. In some examples, the display data elements are referred to as display overlay data, or display overlay elements.

In general, the display data 114 includes multiple layers of video frames, user interface elements, or the like, to be combined, or blended, into a composite frame to be displayed on display 130. For example, the display data 114 can include multiple layers (e.g., RGB formatted layers, or the like) or a video frame to be blended into a composite video frame to be displayed on display 130. In another example, the display data 114 can include multiple user interface elements to be blended together to form a composite user interface to be displayed on display 130. It is noted, these examples are given for illustration purposes only and not to be limiting.

Figure 2:
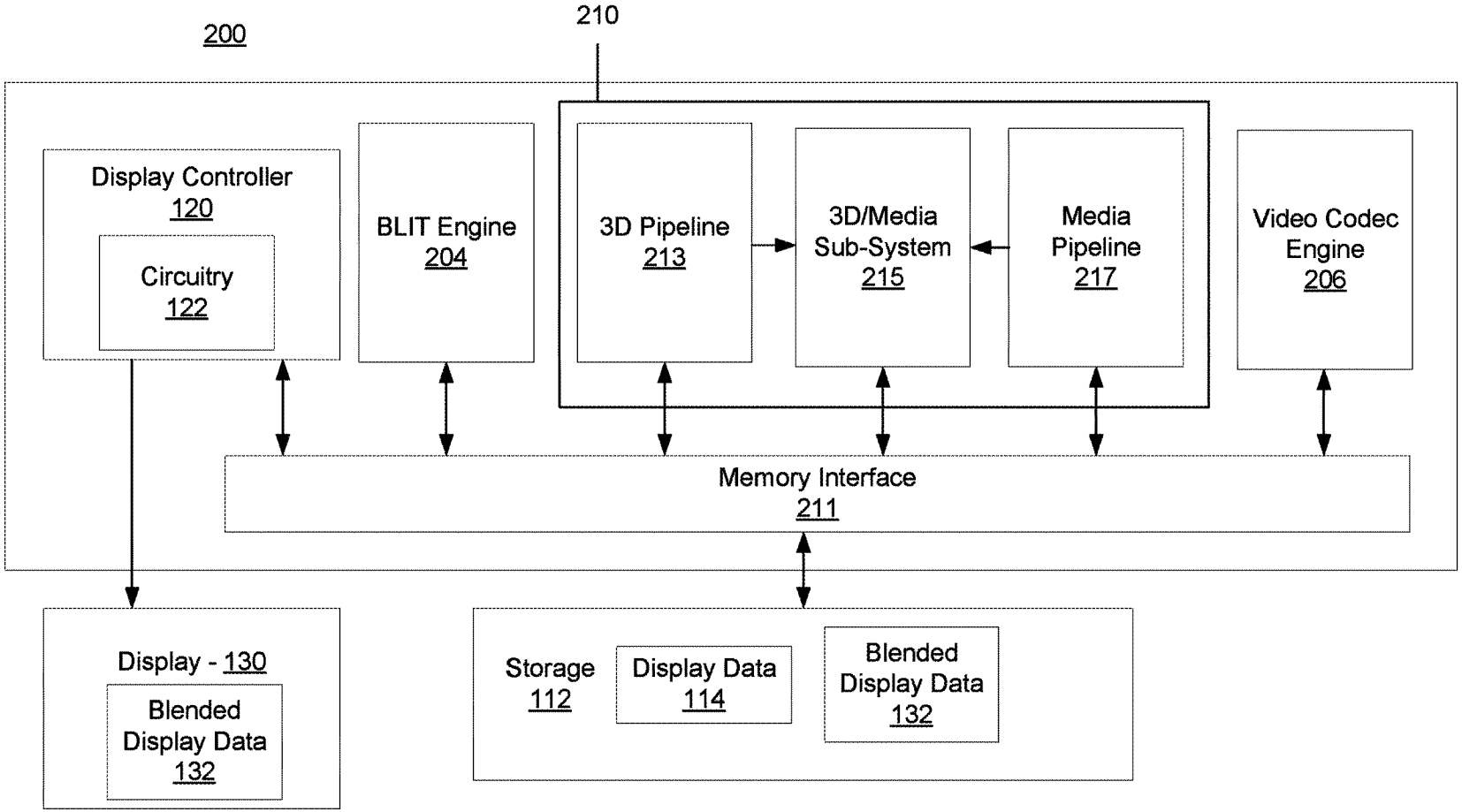
FIG. 2 illustrates a block diagram of a first example display controller according to an embodiment.

In general, the display data source 110 can be any source of display data. For example, the display data source 110 can be sourced from, part of, or associated with a media streaming device, a DVD player, a computer, a smart phone, a tablet, a laptop computer, a home theater receiver, a home automation device, a wearable computing device, a augmented reality device, a virtual reality device, or the like. In some examples, the display data source 110 can generate display data 114 (e.g., via a graphics processor, or the like). For example, the display data source 110 can include computing elements (e.g., a graphics processor as depicted in FIG. 2) to generate display data 114. In some examples, the display data source 110 can receive display data 114 from another source. For example, the display data source 110 can receive display 114 from a cloud based media streaming service, from a cloud based service provider (e.g., cloud hosted computing, or the like).

In general, the display controller 120 drives display output data to display 130. More particularly, the display controller 120 includes features to blend display data 114 into blended display data 132 and send the blended display data 132 to display 130 to be displayed. The display controller 120 includes circuitry 122 to blend display data 114. In general, the circuitry 122 can include elements or functional blocks (e.g., logic gates, transistors, multipliers, adders, or the like) to implement a display data blending process.

Accordingly, during operation, the display controller 120 can generate blended display data 132 from display data 114. The display controller can generate blended display data 132 and send the blended display data 132 to display every t milliseconds. For example, the display controller 120 can generate blended display data 132 from display data 114 and send the blended display data 132 to the display every 16.6 milliseconds. It is noted, that the period in which display controller 120 generates blended display data 132 from display data 114 can depend on the refresh rate of the display 130. In general, the display 130 can have any refresh rate. For example, the display can have a refresh rate of 60 Hz, 90 Hz, 120 Hz, 144 Hz, 240 Hz, or the like.

The display controller 120 can further determine whether the display data 114 is static. This is explained in greater detail below. However, in general, the display controller 120 can determine whether the display data 114 is changing from refresh rate interval to refresh rate interval. In some examples, the display controller 120 can determine whether the display data 114 has been static for a specific number of refresh rate intervals (e.g., 1, 2, 3, 4, 5, 6, 7, 8, 9, 10, or the like). The display controller 120 can cache the most recently generated blended display data 132 to storage 112 based on a determination that the display data 114 has been static for at least a threshold value (e.g., threshold number of refresh intervals, threshold amount of time, or the like). Subsequently, the display controller 120 can send the cached blended display data 132 to the display 130 at each refresh interval. In particular, the display controller 120 can send the previously generated blended display data 132 to the display as opposed to re-blending display data 114. That is, the display controller 120 can refresh the display 130 with previously blended display data 132 until the display data 114 is no longer static.

The display controller 120 can send the blended display data to display 130 via display interconnect 140. Furthermore, the display controller 120 can include an interconnect interface 129. Likewise, display 130 can include interconnect interface 139. In general, the interconnect 140 can be any interconnect to couple display 130 to a computing device (e.g., display controller 120). Likewise, the interconnect interfaces 129 and 139 can be any interface to couple to interconnect 140. For example, interconnect 140 and interfaces 129 and 139 can be high-definition multimedia interface (HDMI) interconnect and interfaces, digital video interface (DVI) interconnect and interfaces, DisplayPort interconnect and interfaces, or the like.

The display 130 can be any type of display or display device, such as, for example, cathode ray tube (CRT) display, light-emitting diode (LED) display, electroluminescent (ELD) display, electronic paper display, E ink display, plasma display panel (PDP) display, liquid crystal display (LCD), high-performance addressing display (HPA), thin-film transistor display (TFT), organic light-emitting diode (OLED) display, or the like. Furthermore, in some examples, the display 130 could be a projector to project an image onto a display surface, such as, for example, a CRT projector, an LCD projector, a digital light processing (DLP) projector, a liquid crystal on silicon (LCoS) projector, an LED projector, a laser diode projector, or the like.

It is noted, that in some examples, the display 130 can be a non-self-refresh type display. More particularly, the display 130 may not include logic and features to implement self-refresh technologies. Examples, however are not limited in this context.

FIG. 2 is a block diagram of a graphics processor 200, which may be a discrete graphics processing unit, or may be a graphics processor integrated with a plurality of processing cores. In general, the graphics processor 200 can generate and/or execute a display pipeline to generate display data 114. In some embodiments, the graphics processor 200 communicates via a memory mapped I/O interface to registers on the graphics processor or with commands placed into the processor memory or both. In some embodiments, graphics processor 200 includes a memory interface 211 to access computer-readable memory storage 112. Memory storage 112 can local memory, one or more internal caches, one or more shared external caches, and/or system memory. As such, memory interface 211 can be an interface to local memory, one or more internal caches, one or more shared external caches, and/or to system memory.

In some embodiments, graphics processor 200 also includes a display controller 120 to drive display output data to a display device 130. Display controller 120 can include circuitry 122 to blend multiple layers of display data 114 to generate blended display data 132. It is noted, that display controller 120 is depicted included in graphics processor 200. However, in some examples, display controller 120 can be separate from graphics processor 200. Examples are not limited in this context.

In some embodiments, graphics processor 200 includes a video codec engine 206 to encode, decode, or transcode media to, from, or between one or more media encoding formats, including, but not limited to Moving Picture Experts Group (MPEG) formats such as MPEG-2, Advanced Video Coding (AVC) formats such as H.264/MPEG-4 AVC, as well as the Society of Motion Picture & Television Engineers (SMPTE) 421M/VC-1, and Joint Photographic Experts Group (JPEG) formats such as JPEG, and Motion JPEG (MJPEG) formats.

In some embodiments, graphics processor 200 includes a block image transfer (BLIT) engine 204 to perform two-dimensional (2D) rasterizer operations including, for example, bit-boundary block transfers. However, in one embodiment, 2D graphics operations are performed using one or more components of graphics processing engine (GPE) 210. In some embodiments, graphics processing engine 210 is a compute engine for performing graphics operations, including three-dimensional (3D) graphics operations and media operations.

In some embodiments, GPE 210 includes a 3D pipeline 213 for performing 3D operations, such as rendering three-dimensional images and scenes using processing functions that act upon 3D primitive shapes (e.g., rectangle, triangle, etc.). The 3D pipeline 213 includes programmable and fixed function elements that perform various tasks within the element and/or spawn execution threads to a 3D/Media sub-system 215. While 3D pipeline 213 can be used to perform media operations, an embodiment of GPE 210 also includes a media pipeline 217 that is specifically used to perform media operations, such as video post-processing and image enhancement.

In some embodiments, media pipeline 217 includes fixed function or programmable logic units to perform one or more specialized media operations, such as video decode acceleration, video de-interlacing, and video encode acceleration in place of, or on behalf of video codec engine 206. In some embodiments, media pipeline 217 additionally includes a thread spawning unit to spawn threads for execution on 3D/Media sub-system 215. The spawned threads perform computations for the media operations on one or more graphics execution units included in 3D/Media subsystem 315.

In some embodiments, 3D/Media subsystem 215 includes logic for executing threads spawned by 3D pipeline 213 and media pipeline 217. In one embodiment, the pipelines send thread execution requests to 3D/Media subsystem 215, which includes thread dispatch logic for arbitrating and dispatching the various requests to available thread execution resources. The execution resources include an array of graphics execution units to process the 3D and media threads. In some embodiments, 3D/Media subsystem 215 includes one or more internal caches for thread instructions and data. In some embodiments, the subsystem also includes shared memory, including registers and addressable memory, to share data between threads and to store output data.

In general, the display controller 120 can generate blended display data 132 from display data 114. Additionally the display controller 120 can cache blended display data 132 in memory storage 112 to storage refresh display device with cached blended display data 132 during periods where display data 114 is static.

Figure 3:
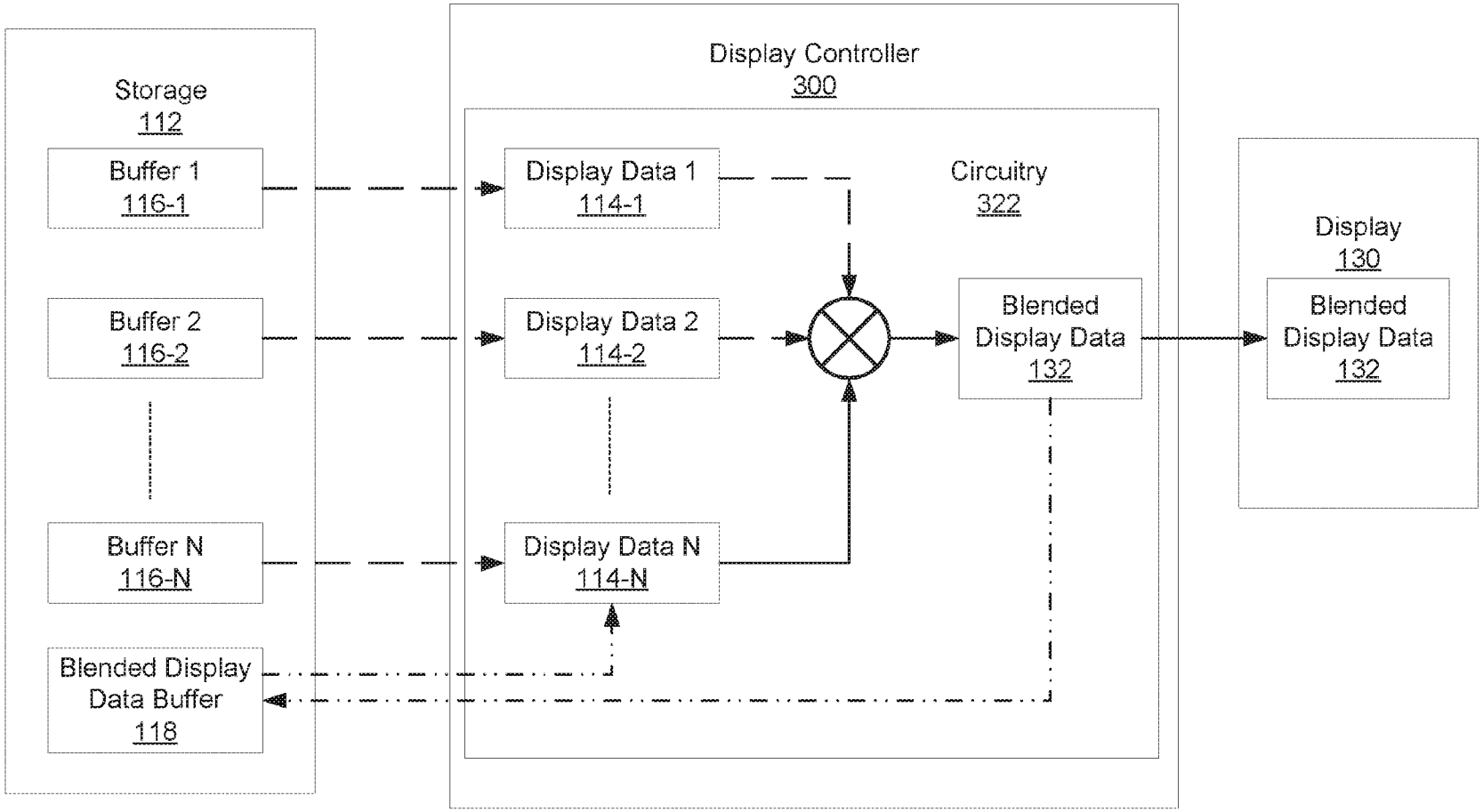
FIG. 3 illustrates a block diagram of a second example display controller according to an embodiment.

FIG. 3 illustrates a block diagram of a display controller 300 in greater detail. In general, the display controller 300 could be implemented as a display controller to provide semi-self-refresh for a non-self-refresh display as described herein. For example, the display controller 300 could be implemented as the display controller 120 of FIG. 1 or the display controller 220 of FIG. 2. However, for purposes of clarity, the display controller is described in the context of the system 100 described with respect to FIG. 1. Examples, however, are not limited in this context.

The display controller 300 includes circuitry 322 to receive display data elements 114-*a*, where "a" is a positive integer. In general, the circuitry 322 can receive any number of display data elements 114-*a*. For example, this figure depicts the circuitry 322 receiving display data element 114-1 and 114-2 through 114-N. Storage 112 can include a number of buffers 116-*b*, where "b" is a positive integer. For example, this figure depicts the storage 112 including buffers 116-1 and 116-2 through 116-N. In some examples, buffers 116-1 and 116-2 through 116-N can include indications of the display data elements 114-1 and 114-2 through 114-N. In some examples, buffers 116-1 and 116-2 through 116-N can include indications of a memory address (e.g., system memory address, or the like) where the display data elements 114-1 and 114-2 through 114-N are stored. Accordingly, the circuitry 322 can retrieve the display data elements 114-1 and 114-2 through 114-N directly from storage 112 (e.g., from buffers 116-1 and 116-2 through 116-N) or the circuitry 322 can retrieve an indications of memory addresses from storage 112 and retrieve the display data elements 114-1 and 114-2 through 114-N from the memory addresses.

The circuitry 322 can blend (e.g., overlay, layer, tile, or the like) display data elements 114-1 and 114-2 through 114-N to form blended display data 132. Additionally, the circuitry 322 can send the blended display data 132 to the display 130.

Additionally, the circuitry 322 can determine whether the display data elements 114-1 and 114-2 through 114-N are static. In some examples, the circuitry 322 can determine whether the display data elements 114-1 and 114-2 through 114-N indicated in the buffers 116-1 and 116-2 through 116-N changes to determine whether the display data elements are static. More specifically, if the data indicated in all the buffers 116-1 and 116-2 through 116-N does not change, then the circuitry 322 can determine that the display data elements 114-1 and 114-2 through 114-N are static. As another example, if the addresses indicated in all the buffers 116-1 and 116-2 through 116-N do not change, then the circuitry 322 can determine that the display data elements 114-1 and 114-2 through 114-N are static. In some examples, the circuitry 322 can determine whether the addresses indicated in the buffers 116-1 and 116-2 through 116-N are static for a threshold number, for example, a threshold number of display refresh intervals.

In general, the circuitry 322 can send blended display data 132 to display 130 in either of two flows. More specifically, the circuitry 322 can send blended display data 132 to the display 130 during periods where the display data elements 114-1 and 114-2 through 114-N are not static (e.g., dashed and solid lines) or the circuitry 322 can send blended display data 132 to the display 130 during periods where the display data elements 114-1 and 114-2 through 114-N are static (e.g., dashed dotter and solid lines).

For example, the circuitry 322 can write the blended display data 132 to blended display buffer 118 in storage 112 based on a determination that the display data 114-1 and 114-2 through 114-N is static. Subsequently, during each display refresh interval, the circuitry 322 can retrieve the blended display data from buffer 118 and send the blended display data 132 to display 130. In some examples, at each refresh interval, the circuitry 322 can determine whether the display data 114-1 and 114-2 through 114-N is static and retrieve blended display data 132 from buffer 118 and send the data 132 to the display 130 based on a determination that the display data 114-1 and 114-2 through 114-N is static.

As another example, the circuitry 322 can retrieve blended display data 114-1 and 114-2 through 114-N and generate blended display data 132 based on a determination that the blended display data 114-1 and 114-2 through 114-N is not static.

Figure 4A:
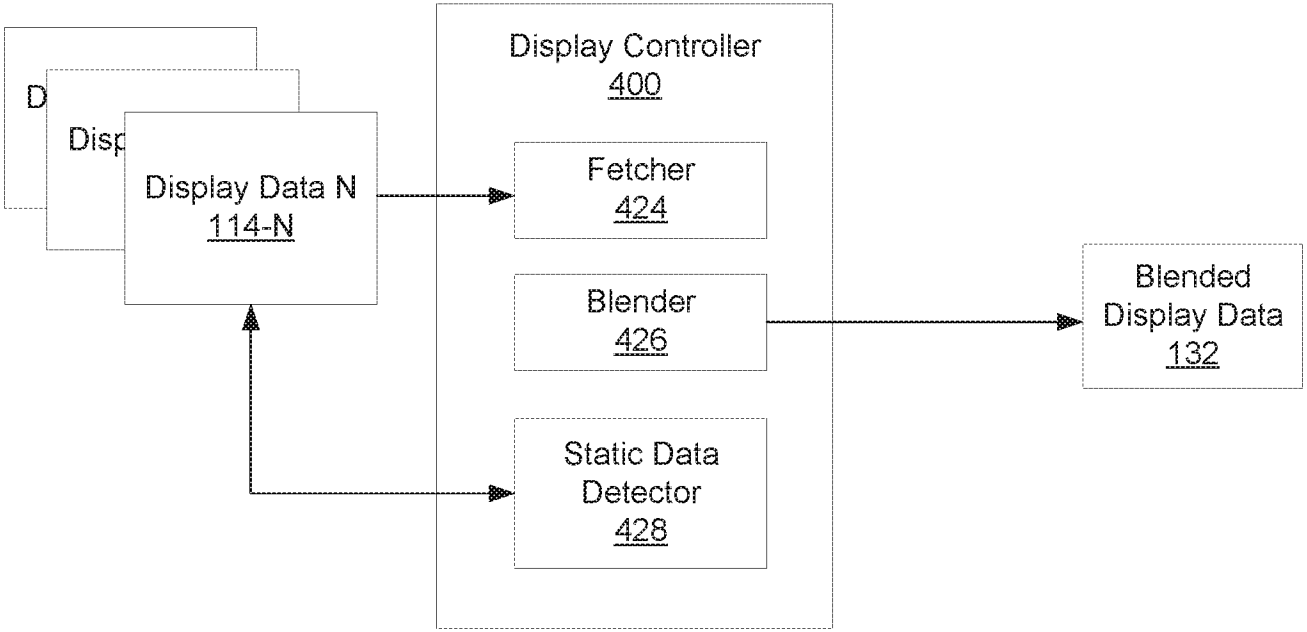
FIGS. 4A-4B illustrate block diagrams of a third example display controller according to an embodiment.
Figure 4B:
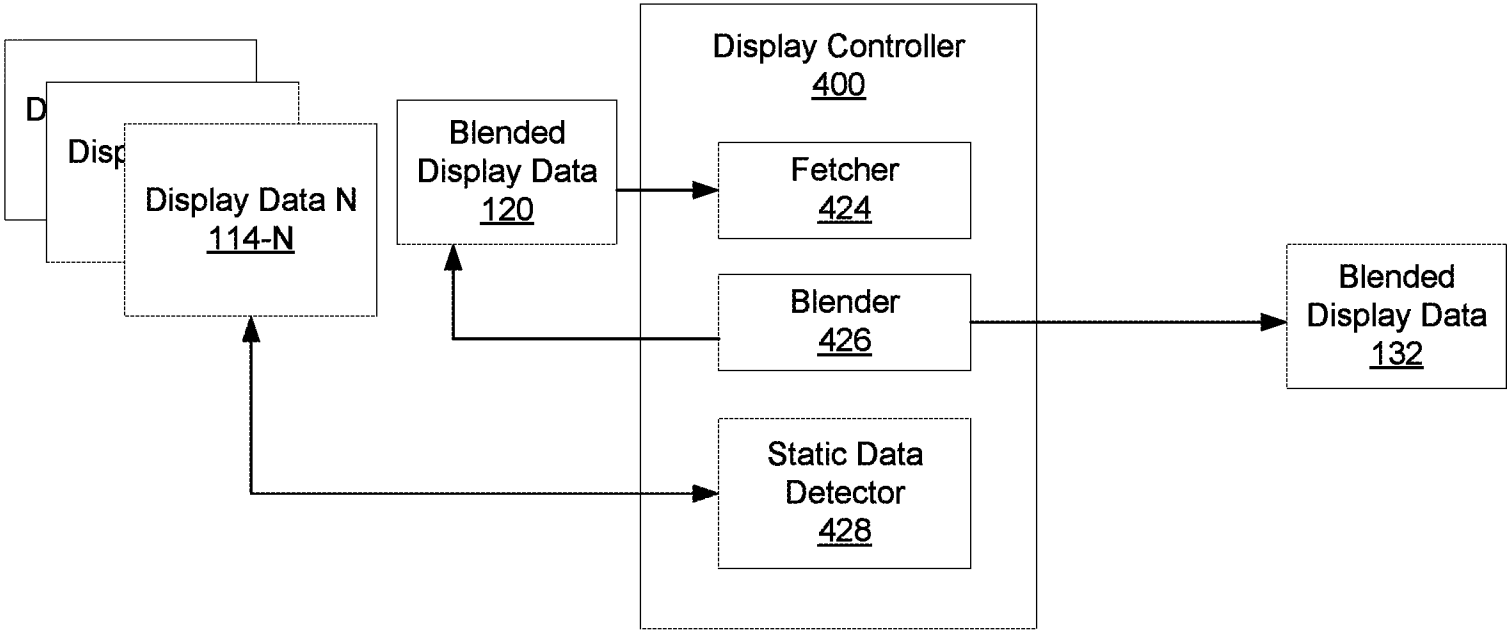

FIGS. 4A-4B illustrate block diagrams of a display controller 400 in greater detail. In general, the display controller 400 could be implemented as a display controller to provide semi-self-refresh for a non-self-refresh display as described herein. For example, the display controller 400 could be implemented as the display controller 120 of FIG. 1 or the display controller 220 of FIG. 2. However, for purposes of clarity, the display controller is described in the context of the system 100 described with respect to FIG. 1. Examples, however, are not limited in this context.

In general, FIGS. 4A-4B depict operations of the display controller 400. In particular, FIG. 4A depicts operations of the display controller 400 during periods where the display data 114 is not static while FIG. 4B depicts operations of the display controller 400 during periods where the display data 114 is static.

Referring to both FIGS. 4A-4B generally, the display controller 400 includes a fetcher 424, a blender 426, and a static data detector 428. In some examples, the fetcher 424, the blender 426, and the static data detector 428 can be implemented as circuitry (e.g., circuitry 122, or the like) computer executable instructions to be executed by a processing element (e.g., processor processor/graphics core 3002 of FIG. 8, or the like), or other logic and circuitry of display controller 400.

Turning more particularly to FIG. 4A, the static data detector 428 can determine whether the display data 114 is static. In particular, the static data detector 428 can determine whether the display data 114 has not changed for more than a threshold number of refresh intervals. Based on a determination that the display data 114 is not static, the fetcher 424 can receive and/or retrieve display data 114. For example, the fetcher 424 can retrieve display data 114 from storage 112, buffers 116, or the like. The blender 426 can blend the display data to generate blended display data 132 and send the blended display data 132 to a display (e.g., display 130, or the like).

Turning more particularly to FIG. 4B, the static data detector 428 can determine whether the display data 114 is static. In particular, the static data detector 428 can determine whether the display data 114 has not changed for more than a threshold number of refresh intervals. Based on a determination that the display data is static, the fetcher 424 can receive and/or retrieve display data 114. For example, the fetcher 424 can retrieve display data 114 from storage 112, buffers 116, or the like. The blender 426 can blend the display data to generate blended display data 132. Additionally, the blender 426 can send the blended display data 132 to a display (e.g., display 130, or the like). Additionally, blender 426 can cache the blended display data (e.g., in storage 112, buffer 118, or the like), for example, after display data 114 has not changed for more than a threshold number of refresh intervals. In particular, blender 426 can cache blended display data 132 once after static detection by static data detector 428 until next static detection. Subsequently, for example, at each following refresh interval, the static data detector 428 can determine whether the display data 114 is static (e.g., has not changed from the last refresh interval, has not changed in more than a threshold number of refresh intervals, or the like). Based on a determination that the display data 114 is static, the fetcher 424 can receive and/or retrieve (e.g., from storage 112, buffer 118, or the like) the blended display data 132 and provide blended display data 132 to a display (e.g., display 130, or the like). If, however, the static data detector 428 determines that the display data 114 is not static, the display controller 400 can return to the operation depicted with respect to FIG. 4A.

Figure 5:
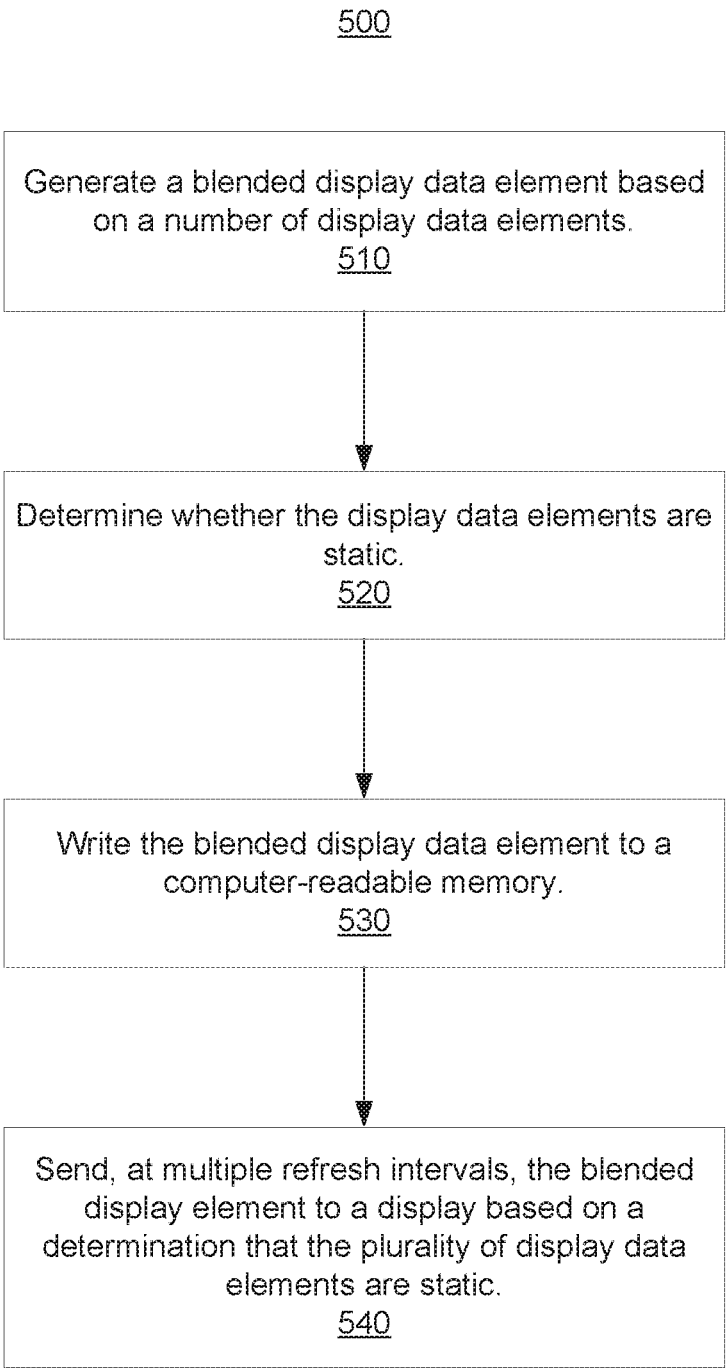
FIG. 5 illustrates a first example logic flow according to an embodiment.
Figure 6:
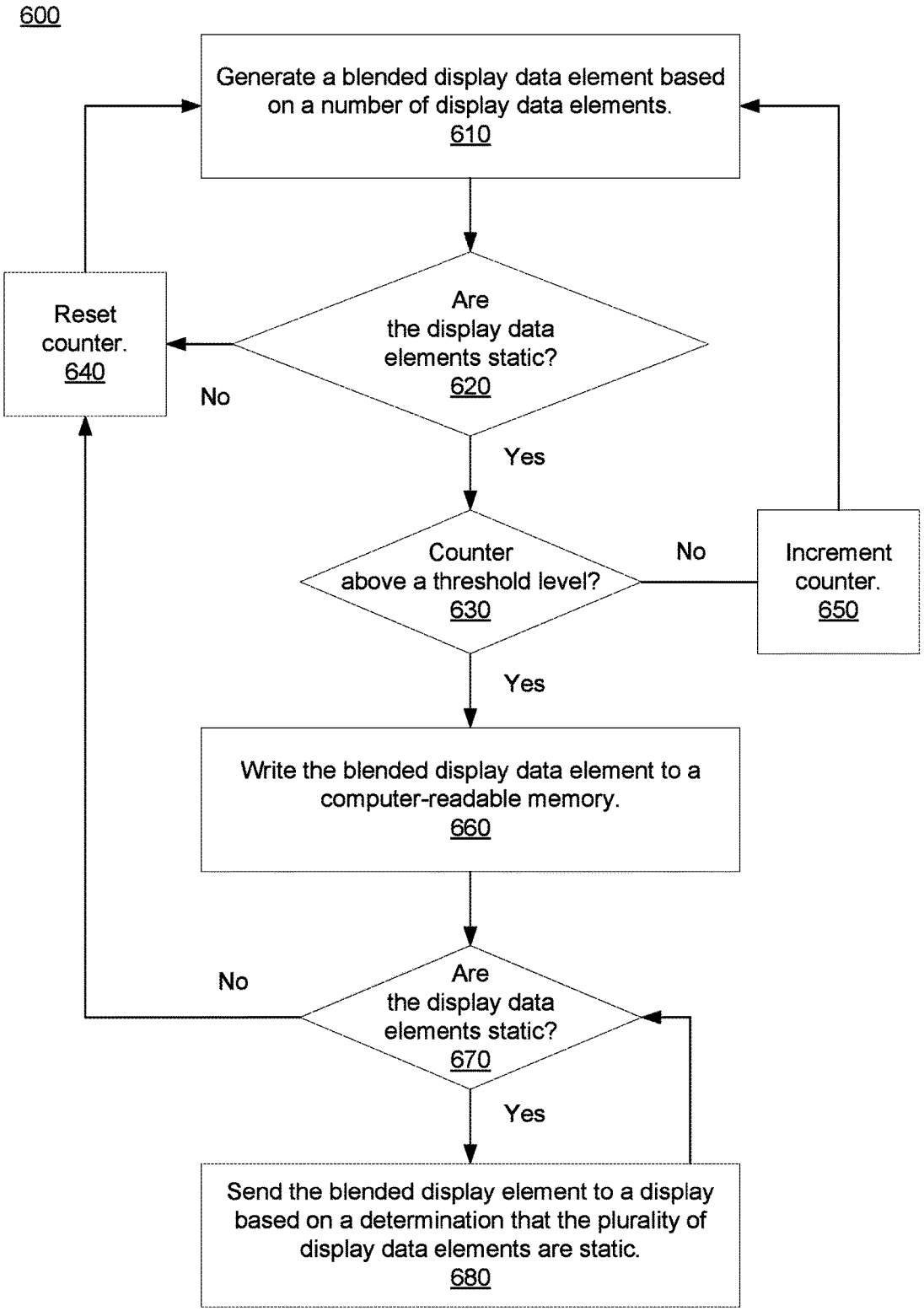
FIG. 6 illustrates a second example logic flow according to an embodiment.

FIGS. 5-6 depict logic flows for semi-self-refreshing onto a non-self-refresh display. The logic flows are descriptive of logic flows that can be implemented by display controllers to provide self-refresh onto a non-self-refresh display panel. For example the logic flows could be implemented by the display controller 100 of FIG. 1, the display controller 200 of FIG. 2, the display controller 300 of FIG. 3, or the display controller 400 of FIGS. 4A-4B. The logic flows are described with reference to the display controller 100 of FIG. 1. Examples, however, are not limited in this context.

Turning more particularly to FIG. 5, logic flow 500 is depicted. The logic flow 500 can begin at block 510. At block 510 "generate a blended display data element based on a number of display data elements" a blended display data element based on a number of display data elements can be generated. For example, the display controller 120 can generate blended display data element 132 from display data elements (e.g., display data elements 114-1 and 114-2 through 114-N). In particular, the circuitry 122 can generate blended display data element 132 by blending display data elements 114.

Continuing to block 520 "determine whether the display data elements are static" it can be determined whether the display data elements are static. For example, the display controller 120 can determine whether the display data elements (e.g., the display data elements 114-1 and 114-2 through 114-N) are static. In particular, the circuitry 122 can determine whether the display data elements 114 (e.g., the data indicated by elements 114, the addresses referenced in buffers 116, or the like) have changed.

Continuing to block 530 "write the blended display data element to a computer-readable memory" the blended display data element can be written to a computer-readable memory. More specifically, an indication of the blended display data element can be written to a storage location. For example, display controller 120 can write blended display data element 132, or an indication of the blended display data element 132, to storage 112. For example, circuitry 122 can write an indication of the blended display data element to buffer 118.

Continuing to block 540 "send, at multiple refresh intervals, the blended display element to a display based on a determination that the plurality of display data elements are static" the blended display data element can be sent, at multiple refresh intervals, to a display. More specifically, the blended display data element stored in the computer-readable memory can be retrieved and sent to the display at a number of refresh intervals while the display data elements are static. For example, the display controller 120 can retrieve the blended display data element 132 from storage 112 and send the blended display data element 132 to display 130 while the display data elements 114 are static.

Turning more particularly to FIG. 6, logic flow 600 is depicted. Logic flow 600 can begin at block 610. At block 610 "generate a blended display data element based on a number of display data elements" a blended display data element based on a number of display data elements can be generated. For example, the display controller 120 can generate blended display data element 132 from display data elements (e.g., display data elements 114-1 and 114-2 through 114-N). In particular, the circuitry 122 can generate blended display data element 132 by blending display data elements 114.

Continuing to decision block 620 "Are the display data elements are static?" it can be determined whether the display data elements are static. For example, the display controller 120 can determine whether the display data elements (e.g., the display data elements 114-1 and 114-2 through 114-N) are static. In particular, the circuitry 122 can determine whether the display data elements 114 (e.g., the data indicated by elements 114, the addresses referenced in buffers 116, or the like) have changed. From decision block 620, the logic flow 600 can continued to decision block 630 or to block 640. In particular, the logic flow 600 can continue from decision block 620 to decision block 630 based on a determination that the display data elements are static while the logic flow 600 can continue from decision block 620 to block 640 based on a determination that the display data elements are not static.

At block 640 "reset the counter" the counter can be reset. For example, the display controller 120 can reset the counter. From block 630, the logic flow 600 can return to block 610.

At decision block 630 "counter above a threshold level?" it can be determined whether the counter is above a threshold level. For example, display controller 120 can determine whether the counter is above a threshold level (e.g., 5, 10, or the like). From decision block 630, the logic flow the logic flow 600 can continued to block 650 or to block 660. In particular, the logic flow 600 can continue from decision block 630 to block 660 based on a determination that the counter is above a threshold level while the logic flow 600 can continue from decision block 630 to block 650 based on a determination that the counter is not above a threshold level.

At block 650 "increment counter" the counter can be incremented, for example, by 1 value. The display controller 120 can increment the counter. The logic flow 600 can return to block 610 from block 650.

At block 660 "write the blended display data element to a computer-readable memory" the blended display data element can be written to a computer-readable memory. More specifically, an indication of the blended display data element can be written to a storage location. For example, display controller 120 can write blended display data element 132, or an indication of the blended display data element 132, to storage 112. For example, circuitry 122 can write an indication of the blended display data element to buffer 118.

Continuing to decision block 670 "Are the display data elements are static?" it can be determined whether the display data elements are static. For example, the display controller 120 can determine whether the display data elements (e.g., the display data elements 114-1 and 114-2 through 114-N) are static. In particular, the circuitry 122 can determine whether the display data elements 114 (e.g., the data indicated by elements 114, the addresses referenced in buffers 116, or the like) have changed. From decision block 670, the logic flow 600 can continued to block 680 or return to block 640. In particular, the logic flow 600 can continue from decision block 670 to block 680 based on a determination that the display data elements are static while the logic flow 600 can continue from decision block 670 to block 640 based on a determination that the display data elements are not static.

At block 680 "send, at multiple refresh intervals, the blended display element to a display based on a determination that the plurality of display data elements are static" the blended display data element can be sent, at multiple refresh intervals, to a display. More specifically, the blended display data element stored in the computer-readable memory can be retrieved and sent to the display. From block 680, the logic flow 600 returns to decision block 670. As such, the logic flow 600 can refresh a display with cached blended display data (e.g., blended display data 132, or the like) during periods where the display data elements are static. For example, the display controller 120 can retrieve the blended display data element 132 from storage 112 and send the blended display data element 132 to display 130 while the display data elements 114 are static.

Figure 7:
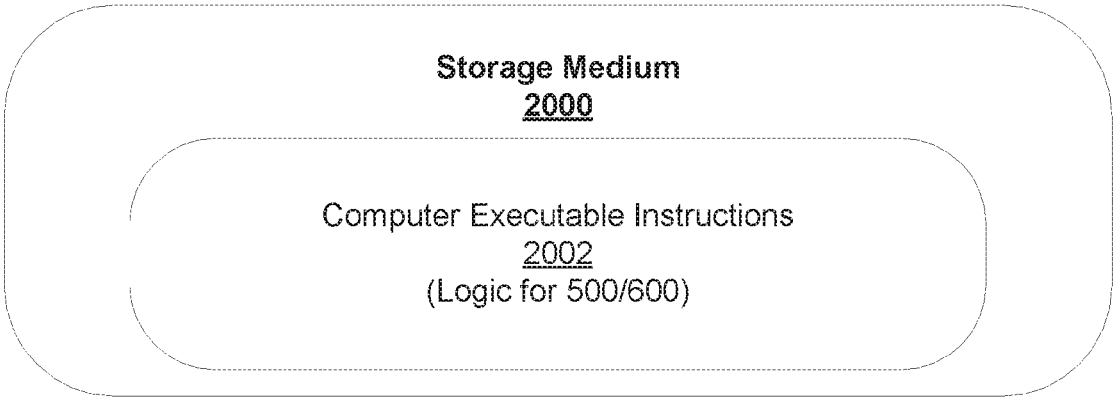
FIG. 7 illustrates a computer readable medium according to an embodiment.

FIG. 7 illustrates an embodiment of a storage medium 2000. The storage medium 2000 may comprise an article of manufacture. In some examples, the storage medium 2000 may include any non-transitory computer readable medium or machine readable medium, such as an optical, magnetic or semiconductor storage. The storage medium 2000 may store various types of computer executable instructions e.g., 2002). For example, the storage medium 2000 may store various types of computer executable instructions to implement logic flow 500. For example, the storage medium 2000 may store various types of computer executable instructions to implement logic flow 600.

Examples of a computer readable or machine readable storage medium may include any tangible media capable of storing electronic data, including volatile memory or non-volatile memory, removable or non-removable memory, erasable or non-erasable memory, writeable or re-writeable memory, and so forth. Examples of computer executable instructions may include any suitable type of code, such as source code, compiled code, interpreted code, executable code, static code, dynamic code, object-oriented code, visual code, and the like. The examples are not limited in this context.

Figure 8:
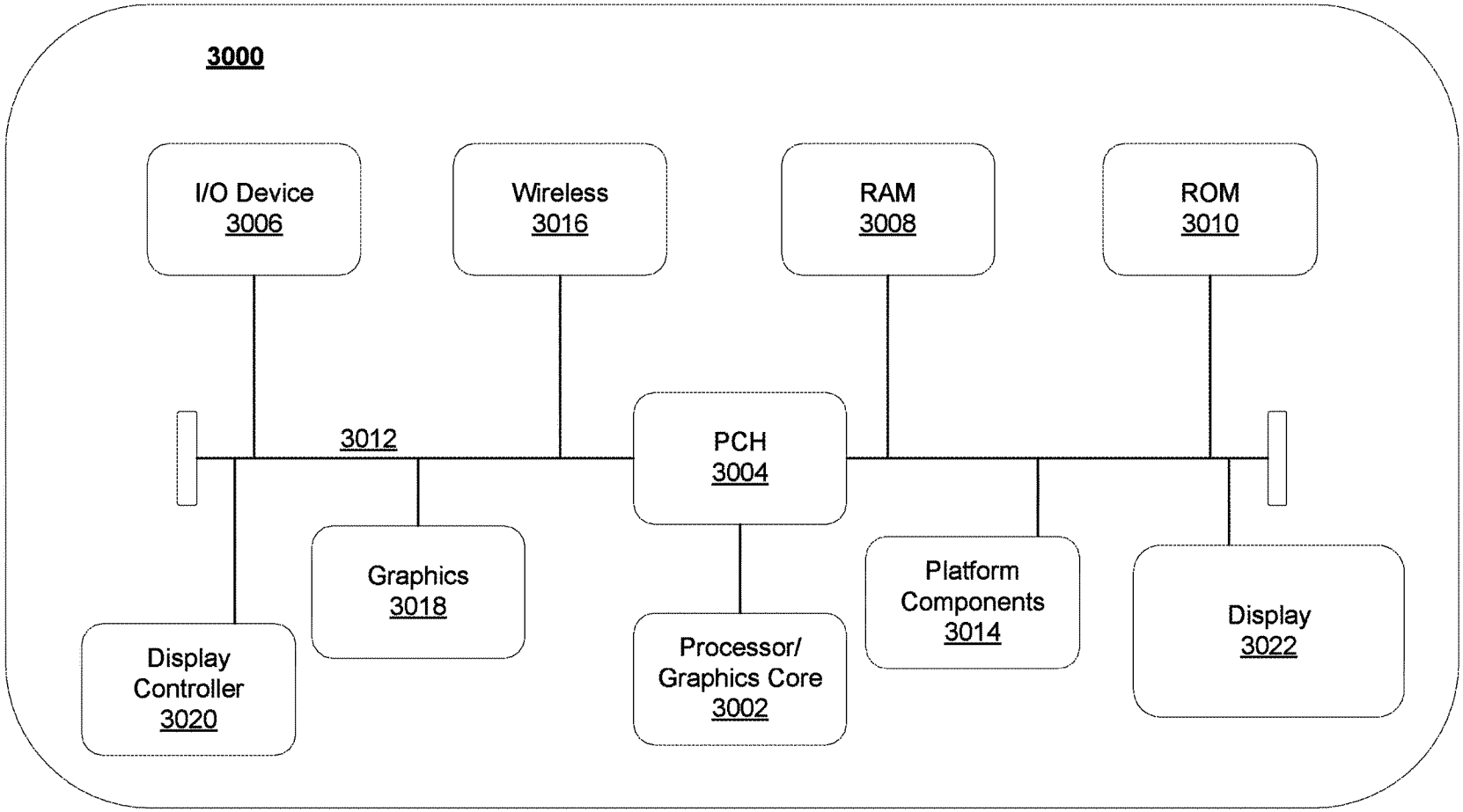
FIG. 8 illustrates a device according to an embodiment.

FIG. 8 is a diagram of an exemplary system embodiment and in particular, depicts a platform 3000, which may include various elements. For instance, this figure depicts that platform (system) 3000 may include a processor/graphics core 3002, a chipset/platform control hub (PCH) 3004, an input/output (I/O) device 3006, a random access memory (RAM) (such as dynamic RAM (DRAM)) 3008, and a read only memory (ROM) 3010, display controller 3020 (e.g., display controller 120, display controller 300, or the like)), display 3022 (e.g., display 130, or the like), and various other platform components 3014 (e.g., a fan, a cross flow blower, a heat sink, DTM system, cooling system, housing, vents, and so forth). System 3000 may also include wireless communications chip 3016 and graphics device 3018. The embodiments, however, are not limited to these elements.

As depicted, I/O device 3006, RAM 3008, and ROM 3010 are coupled to processor 3002 by way of chipset 3004. Chipset 3004 may be coupled to processor 3002 by a bus 3012. Accordingly, bus 3012 may include multiple lines.

Processor 3002 may be a central processing unit comprising one or more processor cores and may include any number of processors having any number of processor cores. The processor 3002 may include any type of processing unit, such as, for example, CPU, multi-processing unit, a reduced instruction set computer (RISC), a processor that have a pipeline, a complex instruction set computer (CISC), digital signal processor (DSP), and so forth. In some embodiments, processor 3002 may be multiple separate processors located on separate integrated circuit chips. In some embodiments processor 3002 may be a processor having integrated graphics, while in other embodiments processor 3002 may be a graphics core or cores.

Some embodiments may be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment. Further, some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other. Furthermore, aspects or elements from different embodiments may be combined.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. The detailed disclosure now turns to providing examples that pertain to further embodiments. The examples provided below are not intended to be limiting.

Example 1

An apparatus, comprising: circuitry to: generate a blended display data element based on a plurality of display data elements; determine whether the plurality of display data elements are static; write the blended display data element to a computer-readable memory; and send, at multiple refresh intervals, the blended display element to a display based on a determination that the plurality of display data elements are static.

Example 2

The apparatus of example 1, the display a non-self-refresh display.

Example 3

The apparatus of example 1, the circuitry comprising a display controller.

Example 4

The apparatus of example 1, the circuitry to retrieve, for each of the plurality of display data elements, an indication of the display data element from a display data buffer, wherein the display data buffers are in the computer-readable memory.

Example 5

The apparatus of example 5, the circuitry to: write an indication of the blended display data element to a blended display data buffer, wherein the blended display data buffer is in the computer-readable memory.

Example 6

The apparatus of any one of examples 1 to 5, wherein the computer-readable memory is system memory.

Example 7

The apparatus of any one of examples 1 to 5, wherein the computer-readable memory comprises graphics frame buffers.

Example 8

The apparatus of any one of examples 1 to 5, wherein the computer-readable memory is graphics processing unit (GPU) memory.

Example 9

The apparatus of any one of examples 1 to 5, the circuitry to: determine whether at least one of the plurality of display data elements changed; and determine the blended display data element is static based on a determination that at least one of the plurality of display data elements did not change.

Example 10

The apparatus of any one of examples 1 to 5, the circuitry to: determine, at each refresh interval, whether the plurality of display data elements are static; and send the blended display element to the display based on a determination that the display data elements are static.

Example 11

The apparatus of any one of examples 1 to 5, the circuitry to: determine, at each refresh interval, whether the plurality of display data elements are static; increment a counter based on a determination that the plurality of display data elements are static; and write the blended display data element to a computer-readable memory based on a determination that the counter is greater than a threshold value.

Example 12

The apparatus of example 11, the circuity to: reset the counter based on a determination that the plurality of display data elements are not static.

Example 13

The apparatus of any one of examples 1 to 5, wherein the plurality of display data elements comprise display overlay data.

Example 14

The apparatus of any one of examples 1 to 5, the circuitry to send the blended display data to the display via a display interconnect.

Example 15

The apparatus of example 14, wherein the display interconnect is a high-definition multimedia interface (HDMI) interconnect, a DisplayPort interconnect, MIPI interconnect, embedded Display port interconnect, a digital video interface (DVI) interconnect, USB type C interconnect, USB interconnect or LVDS interconnect.

Example 16

A method comprising: generating a blended display data element based on a plurality of display data elements; determining whether the plurality of display data elements are static; writing the blended display data element to a computer-readable memory; and sending, at multiple refresh intervals, the blended display element to a display based on a determination that the plurality of display data elements are static.

Example 17

The method of example 16, wherein the display a non-self-refresh display.

Example 18

The method of example 16, comprising: writing, from a display controller, the blended display data element to the computer-readable memory; and sending, from the display controller at multiple refresh intervals, the blended display data element to the display.

Example 19

The method of example 16, comprising retrieving, for each of the plurality of display data elements, an indication of the display data element from a display data buffer, wherein the display data buffers are in the computer-readable memory.

Example 20

The method of example 19, comprising writing an indication of the blended display data element to a blended display data buffer, wherein the blended display data buffer is in the computer-readable memory.

Example 21

The method of any one of examples 16 to 20, wherein the computer-readable memory is system memory.

Example 22

The method of any one of examples 16 to 20, wherein the computer-readable memory comprises graphics frame buffers.

Example 23

The method of any one of examples 16 to 20, wherein the computer-readable memory is graphics processing unit (GPU) memory.

Example 24

The method of any one of examples 16 to 20, comprising: determining whether at least one of the plurality of display data elements changed; and determining the blended display data element is static based on a determination that at least one of the plurality of display data elements did not change.

Example 25

The method of any one of examples 16 to 20, comprising: determining, at each refresh interval, whether the plurality of display data elements are static; and sending the blended display element to the display based on a determination that the display data elements are static.

Example 26

The method of any one of examples 16 to 20, comprising: determining, at each refresh interval, whether the plurality of display data elements are static; incrementing a counter based on a determination that the plurality of display data elements are static; and writing the blended display data element to a computer-readable memory based on a determination that the counter is greater than a threshold value.

Example 27

The method of example 26, comprising resetting the counter based on a determination that the plurality of display data elements are not static.

Example 28

The method of any one of examples 16 to 20, wherein the plurality of display data elements comprise display overlay data.

Example 29

The method of any one of examples 16 to 20, comprising sending the blended display data to the display via a display interconnect.

Example 30

The method of example 29, wherein the display interconnect is a high-definition multimedia interface (HDMI) interconnect, a DisplayPort interconnect, or a digital video interface (DVI) interconnect.

Example 31

An apparatus comprising means for performing the method of any of examples 16 to 30.

Example 32

At least one machine-readable storage medium comprising instructions that when executed by a display controller, cause the display controller to: generate a blended display data element based on a plurality of display data elements; determine whether the plurality of display data elements are static; write the blended display data element to a computer-readable memory; and send, at multiple refresh intervals, the blended display element to a display based on a determination that the plurality of display data elements are static.

Example 33

The at least one machine-readable storage medium of example 32, wherein the display a non-self-refresh display.

Example 34

The at least one machine-readable storage medium of example 32, comprising instructions that when executed by the display controller, cause the display controller to: write, from a display controller, the blended display data element to the computer-readable memory; and send, from the display controller at multiple refresh intervals, the blended display data element to the display.

Example 35

The at least one machine-readable storage medium of example 32, comprising instructions that when executed by the display controller, cause the display controller to retrieve, for each of the plurality of display data elements, an indication of the display data element from a display data buffer, wherein the display data buffers are in the computer-readable memory.

Example 36

The at least one machine-readable storage medium of example 35, comprising instructions that when executed by the display controller, cause the display controller to write an indication of the blended display data element to a blended display data buffer, wherein the blended display data buffer is in the computer-readable memory.

Example 37

The at least one machine-readable storage medium of any one of examples 32 to 36, wherein the computer-readable memory is system memory.

Example 38

The at least one machine-readable storage medium of any one of examples 32 to 36, wherein the computer-readable memory comprises graphics frame buffers.

Example 39

The at least one machine-readable storage medium of any one of examples 32 to 36, wherein the computer-readable memory is graphics processing unit (GPU) memory.

Example 40

The at least one machine-readable storage medium of any one of examples 32 to 36, comprising instructions that when executed by the display controller, cause the display controller to: determine whether at least one of the plurality of display data elements changed; and determine the blended display data element is static based on a determination that at least one of the plurality of display data elements did not change.

Example 41

The at least one machine-readable storage medium of any one of examples 32 to 36, comprising instructions that when executed by the display controller, cause the display controller to: determine, at each refresh interval, whether the plurality of display data elements are static; and send the blended display element to the display based on a determination that the display data elements are static.

Example 42

The at least one machine-readable storage medium of any one of examples 32 to 36, comprising instructions that when executed by the display controller, cause the display controller to: determine, at each refresh interval, whether the plurality of display data elements are static; increment a counter based on a determination that the plurality of display data elements are static; and write the blended display data element to a computer-readable memory based on a determination that the counter is greater than a threshold value.

Example 43

The at least one machine-readable storage medium of example 42, comprising instructions that when executed by the display controller, cause the display controller to reset the counter based on a determination that the plurality of display data elements are not static.

Example 44

The at least one machine-readable storage medium of any one of examples 32 to 36, wherein the plurality of display data elements comprise display overlay data.

Example 45

The at least one machine-readable storage medium of any one of examples 32 to 36, comprising instructions that when executed by the display controller, cause the display controller to send the blended display data to the display via a display interconnect.

Example 46

The at least one machine-readable storage medium of example 45, wherein the display interconnect is a high-definition multimedia interface (HDMI) interconnect, a DisplayPort interconnect, or a digital video interface (DVI) interconnect.

Example 47

A system to semi-self-refresh a display, comprising: a computer-readable memory; and a display controller, the display controller comprising circuitry to: generate a blended display data element based on a plurality of display data elements; determine whether the plurality of display data elements are static; write the blended display data element to the computer-readable memory; and send, at multiple refresh intervals, the blended display element to a display based on a determination that the plurality of display data elements are static.

Example 48

The system of example 47, comprising the display, the display a non-self-refresh display.

Example 49

The system of example 47, the circuitry to retrieve, for each of the plurality of display data elements, an indication of the display data element from a display data buffer, wherein the display data buffers are in the computer-readable memory.

Example 50

The system of example 49, the circuitry to: write an indication of the blended display data element to a blended display data buffer, wherein the blended display data buffer is in the computer-readable memory.

Example 51

The system of any one of examples 47 to 50, wherein the computer-readable memory is system memory.

Example 52

The system of any one of examples 47 to 50, wherein the computer-readable memory comprises graphics frame buffers.

Example 53

The system of any one of examples 47 to 50, wherein the computer-readable memory is graphics processing unit (GPU) memory.

Example 54

The system of any one of examples 47 to 50, the circuitry to: determine whether at least one of the plurality of display data elements changed; and determine the blended display data element is static based on a determination that at least one of the plurality of display data elements did not change.

Example 55

The system of any one of examples 47 to 50, the circuitry to: determine, at each refresh interval, whether the plurality of display data elements are static; and send the blended display element to the display based on a determination that the display data elements are static.

Example 56

The system of any one of examples 47 to 50, the circuitry to: determine, at each refresh interval, whether the plurality of display data elements are static; increment a counter based on a determination that the plurality of display data elements are static; and write the blended display data element to a computer-readable memory based on a determination that the counter is greater than a threshold value.

Example 57

The system of example 56, the circuity to reset the counter based on a determination that the plurality of display data elements are not static.

Example 58

The system of any one of examples 47 to 50, wherein the plurality of display data elements comprise display overlay data.

Example 59

The system of any one of examples 47 to 50, the circuitry to send the blended display data to the display via a display interconnect.

Example 60

The system of example 59, wherein the display interconnect is a high-definition multimedia interface (HDMI) interconnect, a DisplayPort interconnect, or a digital video interface (DVI) interconnect.

Example 61

The system of any one of examples 48, comprising a housing, the computer-readable memory, the display controller, and the display enclosed within the housing.

Example 62

The system of example 61, comprising a battery enclosed within the housing.

What is claimed is:

1. An apparatus, comprising:

circuitry, at least a portion of which is in hardware, the circuitry to:

retrieve a plurality of display data elements from a respective plurality of frame buffers;

generate a blended display data element based on the plurality of display data elements;

determine, at each refresh interval of multiple refresh intervals, whether the plurality of display data elements are static;

increment a counter based on a determination that the plurality of display data elements are static;

write the blended display data element to a computer-readable memory based on a determination that the counter is greater than a threshold value;

send, at multiple refresh intervals, the blended display data element to a display based on a determination that the plurality of display data elements are static; and reset the counter based on a determination that the plurality of display data elements are not static.

2. The apparatus of claim 1, the display a non-self-refresh display.

3. The apparatus of claim 1, the circuitry comprising a display controller.

4. The apparatus of claim 1, the circuitry to retrieve, for each of the plurality of display data elements, an indication of the display data element from a display data buffer, wherein the display data buffers are in the computer-readable memory.

5. The apparatus of claim 4, the circuitry to write an indication of the blended display data element to a blended display data buffer, wherein the blended display data buffer is in the computer-readable memory.

6. The apparatus of claim 1, wherein the computer-readable memory is system memory, wherein the computer-readable memory comprises graphics frame buffers, or wherein the computer-readable memory is graphics processing unit (GPU) memory.

7. The apparatus of claim 1, wherein the plurality of display data elements comprise display overlay data.

8. The apparatus of claim 1, the circuitry to send the blended display data to the display via a display interconnect, wherein the display interconnect is a high-definition multimedia interface (HDMI) interconnect, a DisplayPort interconnect, or a digital video interface (DVI) interconnect.

9. A method comprising:

retrieving a plurality of display data elements from a respective plurality of frame buffers;

generating a blended display data element based on the plurality of display data elements;

determining whether the plurality of display data elements are static;

writing the blended display data element to a computer-readable memory;

sending, at multiple refresh intervals, the blended display data element to a display based on a determination that the plurality of display data elements are static;

determining, at each refresh interval, whether the plurality of display data elements are static;

incrementing a counter based on a determination that the plurality of display data elements are static;

writing the blended display data element to a computer-readable memory based on a determination that the counter is greater than a threshold value; and resetting the counter based on a determination that the plurality of display data elements are not static.

10. The method of claim 9, wherein the display is a non-self-refresh display.

11. The method of claim 9, wherein the computer-readable memory is system memory, wherein the computer-readable memory comprises graphics frame buffers, or wherein the computer-readable memory is graphics processing unit (GPU) memory.

12. At least one non-transitory machine-readable storage medium comprising instructions that when executed by a display controller, cause the display controller to:

retrieve a plurality of display data elements from a respective plurality of frame buffers;

generate a blended display data element based on the plurality of display data elements;

determine whether the plurality of display data elements are static;

write the blended display data element to a computer-readable memory;

send, at multiple refresh intervals, the blended display data element to a display based on a determination that the plurality of display data elements are static;

determine, at each refresh interval, whether the plurality of display data elements are static;

increment a counter based on a determination that the plurality of display data elements are static;

write the blended display data element to a computer-readable memory based on a determination that the counter is greater than a threshold value; and reset the counter based on a determination that the plurality of display data elements are not static.

13. The at least one non-transitory machine-readable storage medium of claim 12, wherein the display is a non-self-refresh display.

14. A system to semi-self-refresh a display, comprising:

a computer-readable memory; and a display controller, the display controller comprising circuitry to:

retrieve a plurality of display data elements from a respective plurality of frame buffers;

generate a blended display data element based on the plurality of display data elements;

determine whether the plurality of display data elements are static;

write the blended display data element to the computer-readable memory;

send, at multiple refresh intervals, the blended display data element to a display based on a determination that the plurality of display data elements are static;

determine, at each refresh interval, whether the plurality of display data elements are static;

increment a counter based on a determination that the plurality of display data elements are static; and write the blended display data element to a computer-readable memory based on a determination that the counter is greater than a threshold value.

15. The system of claim 14, comprising the display, the display a non-self-refresh display.

16. The system of claim 15, the circuitry to write an indication of the blended display data element to a blended display data buffer, wherein the blended display data buffer is in the computer-readable memory.

17. The system of claim 14, wherein the computer-readable memory is system memory, wherein the computer-readable memory comprises graphics frame buffers, or wherein the computer-readable memory is graphics processing unit (GPU) memory.

18. The system of claim 14, the circuity to reset the counter based on a determination that the plurality of display data elements are not static.

19. The system of claim 14, comprising a housing, the computer-readable memory, the display controller, and the display enclosed within the housing.

* * * * *